US010370917B2

(12) United States Patent
Coon

(10) Patent No.: US 10,370,917 B2
(45) **Date of Patent: *Aug. 6, 2019**

(54) ACTUATION DART FOR WELLBORE OPERATIONS, WELLBORE TREATMENT APPARATUS AND METHOD

(71) Applicant: Packers Plus Energy Services Inc., Calgary (CA)

(72) Inventor: Robert Joe Coon, Missouri City, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/600,476

(22) Filed: May 19, 2017

(65) Prior Publication Data

US 2017/0254165 A1 Sep. 7, 2017

Related U.S. Application Data

(63) Continuation of application No. 13/877,739, filed as application No. PCT/CA2011/001133 on Oct. 6, 2011, now Pat. No. 9,683,419.

(60) Provisional application No. 61/390,481, filed on Oct. 6, 2010, provisional application No. 61/390,486, filed on Oct. 6, 2010.

(51) Int. Cl.

| | |
|---|---|
| ***E21B 23/08*** | (2006.01) |
| ***E21B 34/14*** | (2006.01) |
| ***E21B 43/14*** | (2006.01) |
| ***E21B 47/09*** | (2012.01) |

(52) U.S. Cl.

CPC ..... *E21B 23/08* (2013.01); *E21B 34/14* (2013.01); *E21B 43/14* (2013.01); *E21B 47/09* (2013.01)

(58) Field of Classification Search

CPC ..... E21B 23/08; E21B 34/14; E21B 43/14; E21B 47/09

See application file for complete search history.

(56) References Cited

U.S. PATENT DOCUMENTS

| | | | | |
|---|---|---|---|---|
| 3,263,752 | A * | 8/1966 | Conrad | E21B 34/14 166/154 |
| 9,683,419 | B2 * | 6/2017 | Coon | E21B 23/08 |
| 2006/0124310 | A1 * | 6/2006 | Lopez de Cardenas | E21B 34/06 166/313 |
| 2010/0294515 | A1 * | 11/2010 | Xu | E21B 23/006 166/386 |
| 2011/0180274 | A1 * | 7/2011 | Wang | E21B 34/14 166/386 |
| 2011/0240311 | A1 * | 10/2011 | Robison | E21B 23/04 166/373 |
| 2011/0284240 | A1 * | 11/2011 | Chen | E21B 23/00 166/373 |
| 2012/0085538 | A1 * | 4/2012 | Guerrero | E21B 33/12 166/284 |

* cited by examiner

*Primary Examiner* — Waseem Moorad
*Assistant Examiner* — Christopher J Sebesta

(57) ABSTRACT

An actuation dart for actuating a target tool in a tubing string, the actuation dart includes: a body conveyable through the tubing string to reach the target tool; a control module configured to respond to contact with at least one downhole tool in the tubing string to locate the target tool; and an actuation mechanism for actuating the target tool when it is located.

19 Claims, 10 Drawing Sheets

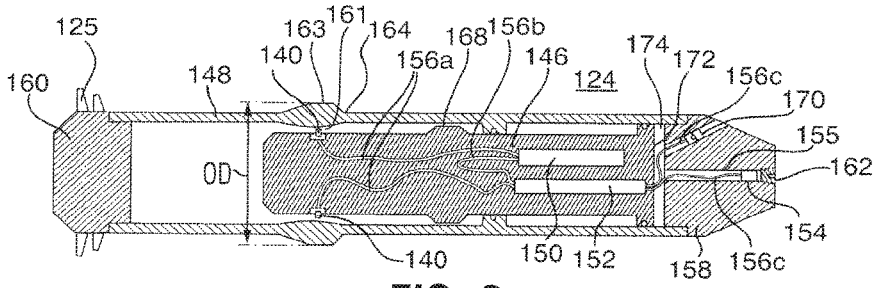
FIG. 2
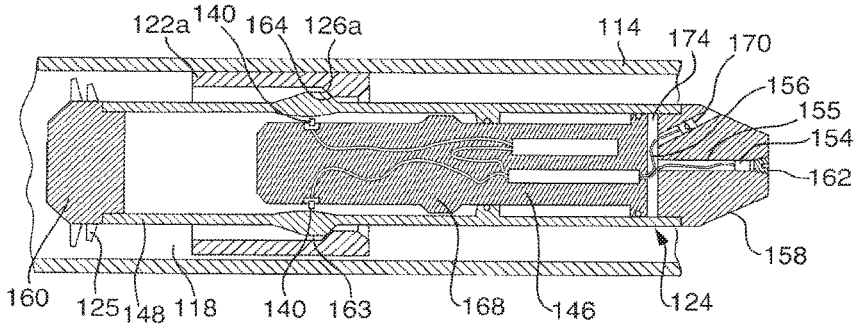
FIG. 3A
FIG. 3B
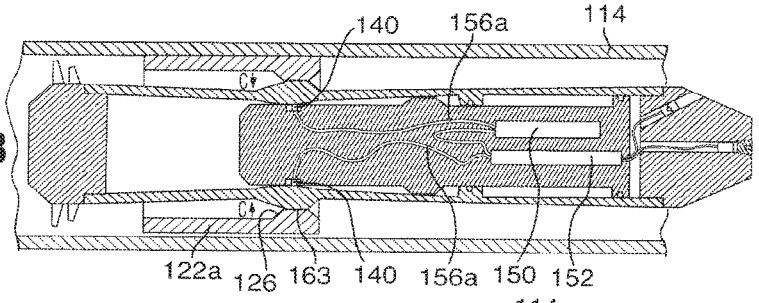
FIG. 3C
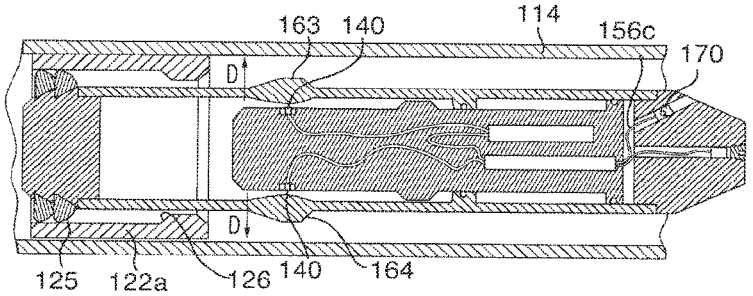

ACTUATION DART FOR WELLBORE OPERATIONS, WELLBORE TREATMENT APPARATUS AND METHOD

CROSS-REFERENCE TO RELATED APPLICATION(S)

This application is a Continuation of U.S. patent application Ser. No. 13/877,739, filed on Apr. 4, 2013, entitled "ACTUATION DART FOR WELLBORE OPERATIONS, WELLBORE TREATMENT APPARATUS AND METHOD," which is a national stage application of International Application No. PCT/CA11/01133, filed on Oct. 6, 2011, entitled: "ACTUATION DART FOR WELLBORE OPERATIONS, WELLBORE TREATMENT APPARATUS AND METHOD," which claims a benefit of priority from U.S. Provisional Application Nos. 61/390,481, filed Oct. 6, 2010, entitled "WELLBORE ACTUATION DART," and 61/390,486, filed Oct. 6, 2010, entitled "WELLBORE ACTUATION DART AND SEAT," all of which are fully incorporated herein by reference.

TECHNICAL FIELD

The invention relates to a method and apparatus for wellbore tool actuation and, in particular, to an actuation dart for selective actuation of a wellbore tool, wellbore treatment apparatus and methods relating thereto.

BACKGROUND OF THE RELATED ART

Recently wellbore treatment apparatus have been developed that include a wellbore treatment string for staged well treatment. The wellbore treatment string is useful to create a plurality of isolated zones within a well and includes an openable port system that allows selected access to each such isolated zone. The treatment string includes a tubular string carrying a plurality of external annular packers that can be set in the hole to create isolated zones therebetween in the annulus between the tubing string and the wellbore wall, be it cased or open hole. Openable ports, passing through the tubing string wall, are positioned between the packers and provide communication between the tubing string inner bore and the isolated zones. The ports are selectively openable and include a sleeve thereover with a sealable seat formed in the inner diameter of the sleeve. By launching a plug, such as a ball, a dart, etc., the plug can seal against the seat of a port's sleeve and pressure can be increased behind the plug to drive the sleeve through the tubing string to open the port and gain access to an isolated zone. The seat in each sleeve can be formed to accept a plug of a selected diameter but to allow plugs of smaller diameters to pass. As such, a port can be selectively opened by launching a particular sized plug, which is selected to seal against the seat of that port.

Unfortunately, however, such a wellbore treatment system may tend to be limited in the number of zones that may be accessed. In particular, limitations with respect to the inner diameter of wellbore tubulars, often due to the inner diameter of the well itself, restrict the number of different sized seats that can be installed in any one string. For example, if the well diameter dictates that the largest sleeve seat in a well can at most accept a 3¾ plug, then the well treatment string will generally be limited to approximately eleven sleeves and, therefore, treatment can only be effected in eleven stages.

SUMMARY OF THE DISCLOSURE

A wellbore actuation dart and method are taught in accordance with aspects of the invention.

In accordance with one aspect of the present invention, there is provided an actuation dart for actuating a target tool in a tubing string, the actuation dart comprising: a body conveyable through the tubing string to reach the target tool; a control module configured to respond to contact with at least one downhole tool in the tubing string to locate the target tool; and an actuation mechanism for actuating the target tool when it is located.

In accordance with another aspect of the present invention, there is provided a method for actuating a target tool in a tubing string, the method comprising: conveying an actuation dart through the tubing string, the actuation dart contacting at least one tool in the tubing string; sensing the contacting with the at least one tool to locate the target tool; and actuating the target tool using the actuation dart.

In accordance with another aspect of the present invention, there is provided a method for staged injection of treatment fluids into selected intervals of a wellbore, the method comprising: running in a fluid treatment string, the fluid treatment string having a plurality of port subs axially spaced apart therealong, each port sub including a port substantially closed against the passage of fluid therethrough; conveying an actuation dart to pass through the tubing string, the actuation dart contacting at least some of the plurality of port subs along the tubing string to locate a target port sub through recognition based on contact with the at least some of the plurality of port subs; actuating the port of the target port sub to open; and injecting wellbore treatment fluid through the port to treat a wellbore interval accessed through the port.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

FIG. 2 is a schematic sectional view through an actuation dart;

FIGS. 3A to 3F are schematic sectional views through a portion of a wellbore tubing string, the sequence of views showing a method of actuating a tool using the dart of FIG. 2.

DETAILED DESCRIPTION OF VARIOUS EMBODIMENTS

Figure 1A:
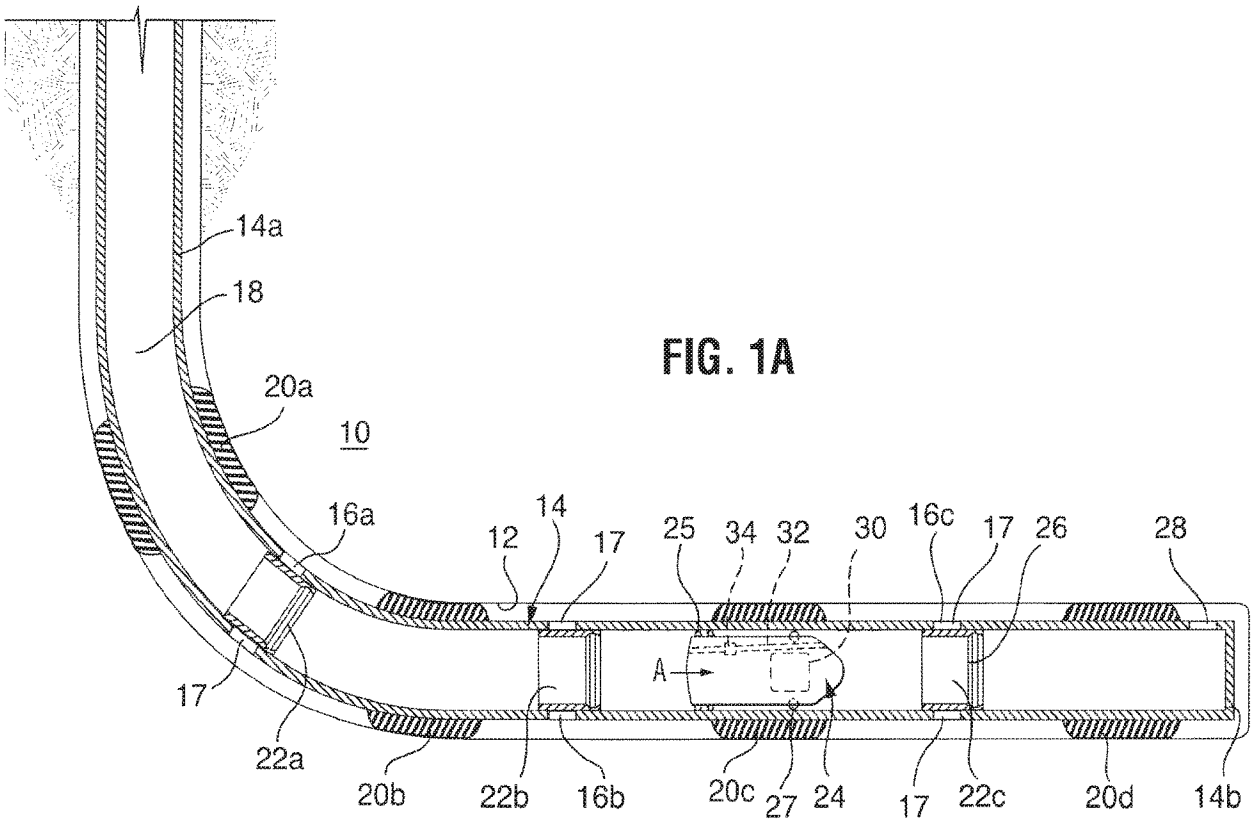
FIGS. 1A, 1B and 1C show a schematic view of a wellbore having installed therein a wellbore treatment apparatus actuated by a dart, the sequence of views showing a method of actuating sleeves in a wellbore treatment apparatus using the dart.

The description that follows and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

A wellbore actuation dart has been invented that is configurable to identify a target tool in a tubing string and to actuate that tool. Apparatus and methods have been invented employing the actuation dart.

The actuation dart includes a body conveyable through a tubing string to reach a target tool and a control module. According to an embodiment, the control module is configured to respond to contact with one or more tools in the tubing string to locate the target tool. The control module is configured to respond to contact, as by sensing, including detecting, recognizing, registering and the like, the one or more tools. The actuation dart also includes an actuation mechanism for actuating the target tool when it is located. Responding to contact may further include causing operation, as by outputting a signal to, powering, and the like, of the actuation mechanism.

The actuation dart may be employed in a method for actuating the target tool. The dart operates by passing through the tubing string and locating the target tool by contacting at least one tool in the tubing string and sensing the contact with the at least one tool to locate the target tool. After the target tool is located, the actuation dart can actuate the tool such as by driving a mechanism engaged by the tool and/or creating a seal in the tubing string adjacent the tool, for example, to block fluid flow therepast including for diversion of wellbore fluids. The target tool may, for example, be a packer, a fluid treatment port, etc. Contacting at least one tool may include contacting the target tool and/or contacting a tool uphole of the target tool. The sensing of the contact may be based on actual contact including electrical contact with the target tool and/or with a tool uphole of the target tool.

In one aspect of the invention the actuation dart is employed in a method and apparatus for staged injection of treatment fluids wherein fluid is injected into one or more selected intervals of the wellbore, while other intervals are closed. In another aspect, the method and apparatus provide for the running in of a fluid treatment string, the fluid treatment string having a plurality of port subs axially spaced apart therealong, each port sub including a port substantially closed against the passage of fluid therethrough, but which is openable by actuation of a closure, when desired, to permit fluid flow through the port into the wellbore; and conveying the actuation dart to pass through the tubing string and contact at least some of the plurality of port subs along the tubing string, to locate a target port sub and to actuate the port of the target port sub to open such that treatment fluid can be passed through the port to treat the interval accessed through the port.

The apparatus and methods of the present invention can be used in various borehole conditions including open holes, cased holes, vertical holes, horizontal holes, straight holes or deviated holes.

Figure 1B:
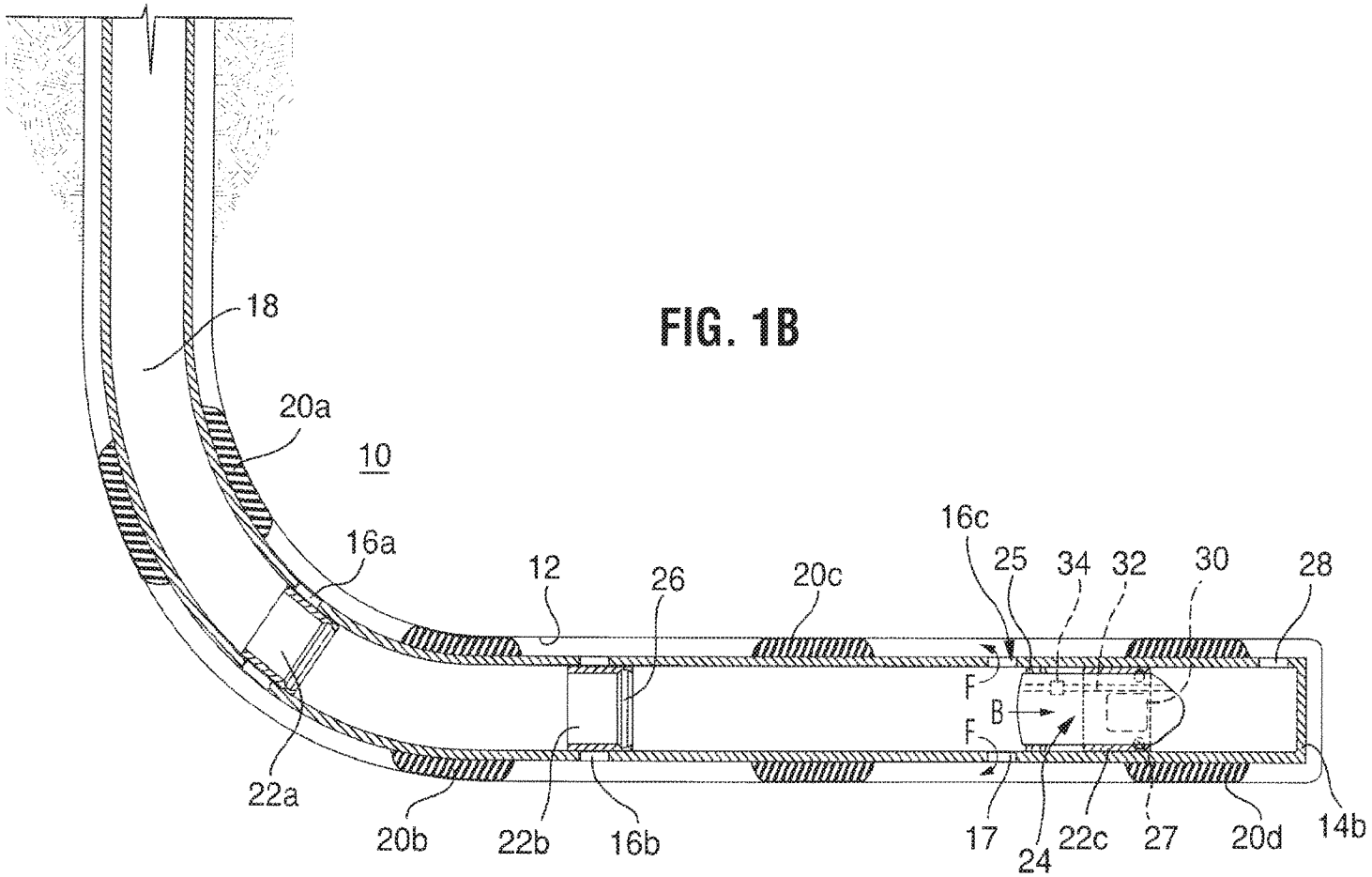
Figure 1C:
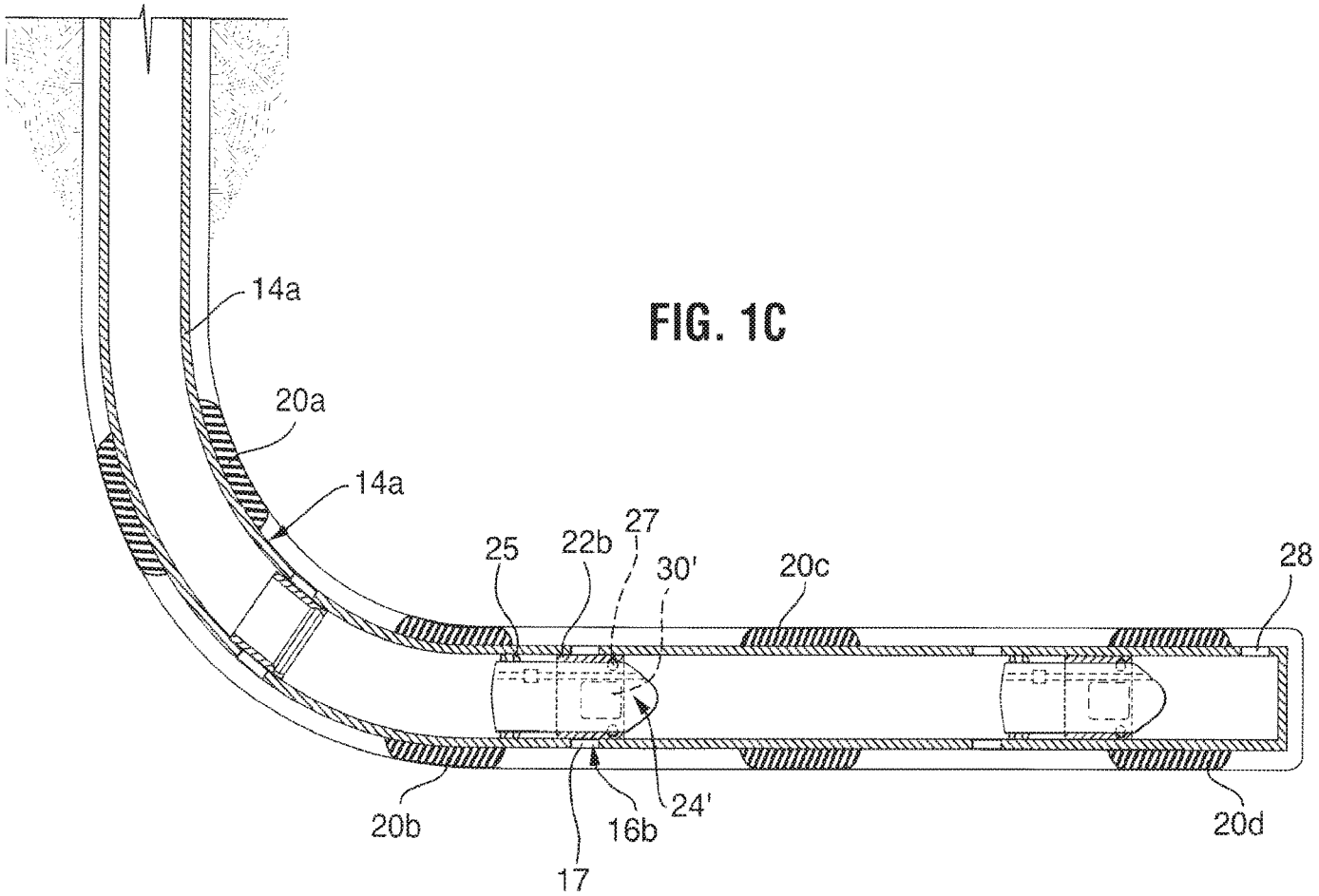

Referring to FIGS. 1A to 1C, a wellbore fluid treatment assembly is shown, which can be used to effect fluid treatment of a formation 10 through a wellbore 12. The wellbore assembly includes a tubing string 14 having an upper end 14*a* extending toward surface (not shown) and a lower end 14*b*. Tubing string 14 includes a plurality of spaced apart ported intervals 16*a* to 16*c* each including a plurality of ports 17 opened through the tubing string wall to permit access between the tubing string inner bore 18 and the wellbore.

A packer 20*a* is mounted between the upper-most ported interval 16*a* and the surface and further packers 20*b* and 20*c* are mounted between each pair of adjacent ported intervals. In the illustrated embodiment, a packer 20*d* is also mounted below the lower-most ported interval 16*c* and lower end 14*b* of the tubing string. The packers are each disposed about the tubing string, encircling it and selected to seal the annulus between the tubing string and the wellbore wall, when the assembly is disposed in the wellbore and the packers are set (as shown). The packers divide the wellbore into isolated zones wherein fluid can be applied to one zone of the well, but is prevented from passing through the annulus into adjacent zones. As will be appreciated, the packers can be spaced in any way relative to the ported intervals to achieve a desired zone length or number of ported intervals per isolated zone. In addition, packer 20*d* need not be present in some applications.

The packers may be of various types. In this illustration, packers 20 are of the solid body-type with at least one extrudable packing element, for example, formed of rubber. Solid body packers including multiple, spaced apart packing elements on a single packer are particularly useful, for example, in open hole (unlined wellbore) operations. In another embodiment, a plurality of packers is positioned in side-by-side relation on the tubing string, rather than using one packer between each ported interval.

Closures in the form of sliding sleeves 22*a* to 22*c* are disposed in the tubing string to control the opening of the ports. In this embodiment, a sliding sleeve is mounted over each ported interval 16*a* to 16*c* to close the ports in that interval against fluid flow therethrough. However, each sleeve can be moved away from its position covering its ports to open that port and allow fluid flow therethrough. In particular, each sliding sleeve may be disposed to control the opening of its ported interval through the tubing string and each may be moveable from a closed port position covering its associated ported interval (as shown by all sleeves in FIG. 1A) to an open port position away from its ports wherein fluid flow of, for example, stimulation fluid, arrows F, is permitted through its ports (as shown by sleeve 22*c* in FIG. 1B). The closures may take other forms such as kobe subs.

The assembly is run in and positioned downhole with the sliding sleeves each in their closed port position. The sleeves are moved to their open position when the tubing string is ready for use in fluid treatment of the wellbore. One or more isolated zones can be treated depending on the sleeves that are opened. For example, in a staged, concentrated treatment process, the sleeves for each isolated zone between adjacent packers may be opened individually to permit fluid flow to one wellbore zone at a time or a plurality of sleeves can be opened to treat a plurality of zones, with a next stage of treatment opening a next plurality of sleeves to access a next plurality of zones.

The sliding sleeves are each actuated by an actuation dart, such as a dart 24, which can be conveyed by gravity or fluid flow through the tubing string. In the illustrated embodiment, dart 24 includes an annular seal 25 about its body. Annular seal 25 is selected to create a substantial seal with the inner wall of the tubing string such that the dart can be pumped by fluid pressure through the string's inner bore 18.

To actuate a sleeve, the actuation dart engages against the sleeve. In this case, dart 24 engages against sleeve 22*c*, and, when pressure is applied through the tubing string inner bore 18 from surface, dart 24 creates a pressure differential above and below the sleeve which drives the sleeve toward the lower pressure side: downhole of the sleeve and the dart.

While many engagement members may be employed such as dogs, shoulders, catches, collets, etc., in the illustrated embodiment, the inner surface of each sleeve which is open to the inner bore of the tubing string includes a groove 26 into which a protrusion 27 on an associated dart 24, when launched from surface, can engage. When the dart's protrusion engages in the sleeve's groove and pressure is applied or increased from surface, a pressure differential is set up, in this case by seal 25 on the dart that seals against the tubing string inner wall. The pressure differential generated causes the sliding sleeve against which the dart has engaged to slide to a port-open position. When the ports of the ported interval 16*c* are opened, fluid can flow through ports 17 to the annulus between the tubing string and the wellbore in the isolated zone between packers and, thereafter, into contact with formation 10. Protrusion 27 on dart 24, therefore, acts as an actuation mechanism in cooperation with seal 25 and groove 26, to actuate the sleeve to move to its port-open position. Other actuation mechanisms can be employed, as will be appreciated based on the example embodiments described hereinbelow.

Dart 24 is configured to identify sleeve 22*c* as a target and to actuate sleeve 22*c*, while the dart neither targets nor actuates other sleeves 22*a*, 22*b*. In particular, as shown, dart 24 is configured to pass by other sleeves 22*a*, 22*b* but locates and actuates sleeve 22*c* when it contacts that sleeve. Dart 24 includes a control module indicated generally by reference 30. As will be described in more detail below, the control module 30 is configured to sense contact with at least one sleeve in the tubing string (i.e. the target sleeve or another sleeve uphole of target sleeve in the tubing string) and, in response to the contact, locate the target sleeve for the dart.

According to an embodiment, the control module 30 comprises an electrical circuit, a power supply and one or more contact sensors to detect one or more contact points on the at least one sleeve in the tubing string.

According to another embodiment, the control module 30 comprises an electronic controller including a board or circuit having a central processor unit, a memory module, a power supply, and an input/output module. The central processor unit may be implemented utilizing a microprocessor-based device operating under stored program control (i.e. firmware or software stored or imbedded in program memory in the memory module) to perform the functions and operations associated with the actuation dart as described herein. The input/output module comprises hardware and/or software components or elements for sensing contact with at least one sleeve in the tubing string. According to an exemplary implementation, the input/output module comprises one or more contact sensors configured to achieve an electrical communication with the at least one sleeve. According to another exemplary implementation, the input/output module includes one or more contact sensors configured to detect one or more contact points with the target and to generate one or more output signals for further processing by the central processor unit. The specific implementation details of the control unit and the stored program control (i.e. firmware or software) will be readily within the understanding of one skilled in the art. According to another embodiment, the control module 30 may be implemented in the form of a programmable device (e.g. a Field Programmable Gate Array or FPGA) and/or dedicated hardware circuits. The specific implementation details will be readily within the understanding of one skilled in the art.

If it is desired to open another ported interval in the tubing string, another dart can be conveyed. For example, as shown in FIG. 1C, another dart 24' can be launched from surface with a configuration to identify sleeve 22*b* as a target and to actuate sleeve 22*b*, while it does not actuate sleeve 22*a*, even though the dart passes by sleeve 22*a* to reach sleeve 22*b*. Dart 24' is similar structurally to dart 24. For example, dart 24' has a body with a similar diameter to that of dart 24 and a seal 25 and a protrusion 27, both of which are similar to those on dart 24. Dart 24' also includes a control module 30', but the control module 30' is configured to respond to contact with at least one of sleeve 22*b* or sleeve 22*a* in the tubing string to recognize sleeve 22*b* as its target. The control module 30' can take various forms or implementations to recognize its target sleeve 22*b*. In one embodiment, the control module 30' includes all the same components as control module 30, but it is programmed to target sleeve 22*b*, while the control module 30 is programmed to target sleeve 22*c*.

Since a dart may block the tubing string inner bore, the darts may be launched in an order corresponding to the positions of their target sleeves in the tubing string. For example, the dart targeted to the lowest sleeve (i.e. the one closest to end 14*b*) may be launched first, followed by the dart for the sleeve next closest to surface and followed by the dart for the sleeve next closest to surface. For example, in the illustrated tubing string, dart 24 is configured to target sleeve 22*c* and is launched first. Dart 24' is configured to target sleeve 22*b* and is launched next and, finally, a dart (not shown) configured to target sleeve 22*a*, which is closest to surface, is launched last.

Darts 24, 24' create a seal in the tubing string. While this may be useful for wellbore treatment, their continued presence downhole may adversely affect backflow of fluids, such as production fluids, through tubing string 14. Thus, darts 24, 24' may be selected to be moveable with backflow back toward surface. Alternately, the darts 24, 24' may include a valve openable in response to backflow, such as a one way valve or a bypass port openable in a period of time after their use as a flow diverter. In one embodiment, as shown, the darts each include a bypass channel 32 having a valve 34 therein powered to open a selected time, such as hours or days, after the dart locates in its target sleeve. According to an exemplary implementation, the respective control module 30, for example the input/output module, is configured with an actuator (e.g. solenoid or motor with a controller) for activating or controlling operation of the bypass channel 32. In another embodiment, at least the bodies of the darts are formed of a material dissolvable at downhole conditions. For example, the bodies may be formed of a material dissolvable in hydrocarbons such that they dissolve when exposed to back flow of production fluids.

Lower end 14*b* of the tubing string can be open, closed or fitted in various ways, depending on the operational characteristics of the tubing string, which are desired. In the illustrated embodiment, lower end 14*b* includes a pump out plug 28. Pump out plug 28 acts to close off end 14*b* during run in of the tubing string, to maintain the inner bore of the tubing string relatively clear. However, by application of fluid pressure, for example at a pressure of about 3000 psi, the plug can be blown out to allow fluid conductivity through string 14. As will be appreciated, an opening adjacent end 14*b* is only needed where pressure, as opposed to gravity, is needed to convey the first dart to land in the lower-most sleeve. In other embodiments, not shown, end 14*b* can be left open or can be closed for example by installation of a welded or threaded plug.

While the illustrated tubing string includes three ported intervals, it is to be understood that any number of ported intervals could be used. In a fluid treatment assembly desired to be used for staged fluid treatment, at least two ported intervals are provided with openable ports from the tubing string inner bore to the wellbore are provided. It is also to be understood that any number of ports can be used in each interval. It is also to be understood that there can be other tubing string components. There can be other sleeves in the string such as a sleeve below sleeve 22*c*, which is hydraulically actuated, including a fluid actuated piston secured by shear pins, so that the sleeve can be opened remotely without the need to land a dart therein. Alternately or in addition, there may be plug actuated sleeves having graduated sized seats. Centralizers, liner hangers and other standard tubing string attachments can be used, as desired.

In use, the wellbore fluid treatment apparatus, as described with respect to FIGS. 1A to 1C, can be used in the fluid treatment of a wellbore, for example, for staged injection of treatment fluids, wherein fluid is injected into one or more selected intervals of the wellbore, while other intervals are closed. In one aspect, the method includes running in of fluid treatment string 14 with its ports 17 substantially closed against the passage of fluid therethrough by sliding sleeves 22. Thereafter, as shown in FIG. 1A, an actuation dart, here shown as dart 24, is passed through tubing string inner diameter 12 to contact at least one port along the tubing string, to locate sleeve 22*c* of a target port and to actuate that port to open (FIG. 1B) such that treatment fluid, arrows F, can be passed through the port to treat the zone accessed through the port.

Each dart, such as dart 24, operates by passing, arrows A, through the tubing string inner bore 18 (FIG. 1A) and locating its target sleeve 22*c* by contacting at least one sleeve in the tubing string and based on the contact, sensing, as by recognizing, detecting, registering or otherwise sensing the contact and the control module 30 processing the contact to recognize, detect, register or otherwise identify the target sleeve 22*c*. After locating its target sleeve, FIG. 1B, actuation dart 24 can actuate the sleeve to open as by engaging the sleeve and driving it away from ports 17 that the sleeve overlies. In the illustrated embodiment, dart 24 opens sleeve 22*c* by engaging the sleeve and creating a seal in inner bore 18 above and below which can be generated a pressure differential to shift the sleeve down in the string, arrows B. After opening sleeve 22*c*, dart 24 remains in the inner diameter to divert fluid through the now exposed ports 17.

Contacting at least one sleeve may include contacting the target sleeve and/or contacting a sleeve uphole of the target sleeve. According to an embodiment, the control module 30 is configured to execute one or more software, firmware or hardware components or functions to detect, identify or recognize the target sleeve based on contact with the target sleeve, contact with a sleeve other than the target sleeve or contact with one or more sleeves uphole of the target sleeves and contact with the target sleeve.

For selectively treating formation 10 through wellbore 12, the above-described tubing string 14 is run into the borehole and packers 20 are set to seal the annulus at each location creating a plurality of isolated annulus zones. In this embodiment, dart 24 is free of any connections to surface and is moved by fluid pressure and thus, fluid conductivity through string 14 is required to achieve conveyance of the dart. To obtain fluid conductivity, fluids can then be pumped down the tubing string to pump out plug assembly 28. Alternately, a plurality of open ports or an open end can be provided or lower most sleeve can be hydraulically openable. Once that injectivity is achieved, dart 24 is launched from surface and conveyed by fluid pressure.

Before launching the dart, the target sleeve for that dart is selected and the control module for the dart is configured to target the dart to that sleeve. According to an embodiment, the control module is configured with a communication interface, for example, a port for connecting a communication cable or a wireless port (e.g. Radio Frequency or RF port) for receiving (transmitting) radio frequency signals for programming or configuring the control module to recognize specific target sleeves. According to another aspect, the control module is configured with an input port comprising one or more user settable switches that are set to identify a specific target sleeve. The configuration provides the dart with the capability to locate the target sleeve by contacting at least one sleeve as it travels through the string. While sleeves 22*a*, 22*b* and 22*c* are all substantially similar to each other in this embodiment, in some embodiments, the target sleeve may also be configured uniquely prior to run in to be independently recognizable based on contact by the dart, from all other sleeves in the string.

Dart 24 is configured to pass though all of the sleeves, including sleeves 22*a*, 22*b* closer to surface, without sealing thereagainst, but stops and engages in its target sleeve 22*c*. When dart 24 engages against sleeve 22*c*, seal 25 seals off fluid access to the tubing string below sleeve 22 and drives the dart, which in turn drives sleeve 22*c* to open ported interval 16*c*. This may allow this isolated zone (i.e. the zone between packer 20*c* and packer 20*d*) to be treated with fluid and/or the port can permit flow of production fluids therethrough. If injecting fluids, the treating fluids will be diverted through the ports of interval 16*c* that are exposed by moving the sliding sleeve and will be directed to a specific area of the formation.

When fluid treatment through ported interval 16*c* is complete, another dart 24' may be launched that is sized to pass through all of the sleeves, including sleeve 22*a* closer to surface, and to engage in and move sleeve 22*b*. Prior to launching, dart 24' is configured to target sleeve 22*b* by contacting either or both of sleeves 22*a*, 22*b* such that it can identify sleeve 22*b*, engage that sleeve and actuate it to open the ports of ported interval 16*b* (FIG. 1C). In particular, in this illustrated embodiment, when dart 24' engages in its target sleeve, a pressure differential can be established across the dart, which drives the dart and the sleeve down to open ported interval 16*b* and permits fluid treatment of the annulus between packers 20*b* and 20*c*.

This process of launching darts for the sleeves progressively closer to surface is repeated until all of the zones of interest are treated. The darts can be launched without stopping the flow of treating fluids. After treatment, fluids can be shut in or flowed back immediately. Once fluid pressure is reduced from surface, any darts engaged in sleeves 22 can be removed, if desired, to permit fluid flow upwardly through inner diameter 18. For example, darts 24, 24' can be unseated by pressure from below and pushed back toward surface, the darts can have bypass channels opened therethrough, the darts can dissolve or the darts can be drilled out.

The apparatus is particularly useful for stimulation of a formation, using stimulation fluids, such as for example, acid, water, oil, CO2 and/or nitrogen, with or without proppants.

As noted above, the control modules 30, 30' may take various forms. Based on the particular implementation details, the control modules may include any of electronic circuits, logic components, actuators, contacts and transducers, programmable controllers, sensors, counters, timers, communication interfaces and circuits, and power supplies, as will be readily understood by one skilled in the art. The control modules can be configured to function in various ways to allow the dart to recognize a target sleeve based on contact of the dart with one or more of the sleeves of the tubing string.

One embodiment of a dart 124 and a method for use thereof is disclosed with reference to FIGS. 2 and 3.

The dart of FIGS. 2 and 3 is employed in a tubing string 114 for passing along the tubing string and actuating a tool therein, the tool includes a sliding sleeve valve 122*c*. In this embodiment, tubing string 114 in which dart 124 is to be used includes a plurality of sleeves 122*a*, 122*b*, 122*c* having seats 126 thereon. The sleeves and seats may each be substantially similar. For example, the diameter at each of seats 126 may be substantially the same.

Dart 124 is configured to have a selected one of the sleeves as a target. The dart in this embodiment includes a control module configured with a counter and the dart is configured, as, for example, by simple programming, to target a sleeve based on the number of that sleeve from surface. The number may be all of the sleeves contacted in order to reach the target sleeve. For example, if a dart is to be launched into a tubing string containing five sleeves and the dart is intended to target the sleeve closest to the distal end, the dart would be programmed to target the fifth sleeve. The number may be the actual number of the target sleeve, in such a case the number in the foregoing example would be five, or the number may be the total of all the sleeves to be passed before reaching the target sleeve, in which case the number in the foregoing example would be four. As dart 124 moves through tubing string 114, it contacts the sleeves in the string and counts the sleeves that it passes, locating its target sleeve 122*c* as a result of the count. In the illustrated embodiment, for example, the control module in the dart 124 is configured, to count the sleeves by registering when the seat 126 of each sleeve has been contacted and counting each seat that it passes. The dart may have a protrusion, for example, that catches on the sleeves in the string as it passes them, such that each sleeve is sensed and can be registered. While dart 124 is capable of passing through all non-targeted seats, the dart is configured to land in and be stopped against seat 126 of its target sleeve, when the count indicates that the dart is due to arrive, or has arrived, at the target seat.

A control module for dart 124 can include a counter including for example an interface such as a switch 140 that senses, and allows the dart to register and count, when the dart passes a seat. For example, switch 140 may be positioned on the dart body to be acted upon, for example depressed, by a seat as the dart passes through the inner diameter constriction at a seat. In response to being depressed, the switch 140 generates an output signal which is inputted to or read by other components of the control module. In one embodiment, a plurality of switches 140 are spaced about a circumference of the dart, allowing the dart to recognize the passage of a seat versus another impact or bump as it passes along string 112. In such an embodiment, a bump or impact may depress one switch of the plurality of switches, but that would not be registered as a counted seat. Instead, a seat is counted only when all switches about the circumference are depressed at about the same time.

While switches 140 can be exposed for direct contact with the sleeve seats, in the illustrated embodiment, the switches are shielded from direct contact to enhance durability. In particular, dart 124 includes an inner body 146 carrying switches 140 and an outer housing 148 about the inner body and overlying the switches. Inner body 146 also, in this embodiment, carries the further components for the control module including a battery 150, for powering the control module, and the control module comprises a circuit board 152 including a programmable controller (e.g. a microprocessor-based device operating under stored program control), a communication port 154 for communication with an external controller and an input/output module comprising lines 156*a*, 156*b*, 156*c* connecting the components. In the illustrated embodiment, dart 124 further includes a nose structure 158 and a trailing end structure 160 between which the outer housing and inner body are mounted. Communication port 154, in this embodiment, is mounted in a hole 155 in nose structure 158 and a removable protective plug 162 is installed over communication port 154 to protect the port and prevent fluid passage into and out of hole 155. Of course, various modifications will be readily apparent to one skilled in the art.

Outer housing 148 is resilient and can resiliently collapse inwardly to compress switches, when a compressive force is applied thereto but can regain its shape and release pressure on switches, when the compressive force is removed. Outer housing 148 can be formed of various resilient materials and in one embodiment has the form of a collet including a plurality of elongate flexible segments.

Inner body 146 has an outer diameter that is less than the inner diameter of outer housing 148. Thus, while the inner body is positioned within the outer housing, an open annulus 161 is present between the parts 146, 148 such that housing 148 has room to collapse inwardly before depressing switches 140.

Outer housing 148 is selected to register when the dart passes through a seat of a sleeve in the tubing string. In particular, outer housing 148 is selected with consideration as to the tubing string in which the dart is to be used to have an outer diameter OD of greater than the diameter across the seats 126 of the sleeves, that diameter being substantially consistent across all sleeve seats. As such, when a dart reaches a sleeve and passes through the sleeve seat, outer housing 148 is compressed by the seat and relays that compressive force to switches 140 by bearing against them. While the entire outer housing of the dart could be formed with an outer diameter of greater than the tubing string seat diameter, use of the dart may be facilitated if only a short length of the outer housing has the outer diameter OD of greater than the tubing string seat diameter, while the remaining portion has a diameter less than the seat diameter. For example, as illustrated by the shaping of the flexible segments a short annular protrusion 163 may be formed on the outer housing that has outer diameter OD and which is the portion against which the compressive force is applied when passing a sleeve seat. The leading end 158 may have a diameter less than the seat diameter such that the dart initially, easily passes through the seat allowing the dart to be more centrally positioned and substantially axially aligned as protrusion 163 approaches the seat.

Dart 124 includes an annular seal 125 about its body that is selected to create a substantial seal with the inner wall of the tubing string such that the dart can be pumped by fluid pressure through the string's inner bore 118.

Dart 124 also includes an actuation mechanism to actuate its target sleeve. In this embodiment, dart 124 includes a no-go shoulder 164 that engages against the seat of its target sleeve 122*c*, and, when pressure is applied through the tubing string inner bore 118 from surface, dart 124 creates a pressure differential which drives the dart against the sleeve and in turn the sleeve is driven toward the lower pressure side: downhole of the sleeve.

While many engagement members may be employed in this embodiment outer housing 148, and in particular the collet create the no-go shoulder that engages on the target sleeve. In this illustrated embodiment, dart 124 includes an inactive position (FIGS. 2 and 3A to 3C), where the no-go shoulder is not yet formed, and an active position (FIGS. 3D and 3E), where no-go shoulder 164 is formed and able to engage against a seat 126.

Dart 124 is configurable from the inactive position to the active position in response to the count. When the count indicates that the next seat to be reached is the target seat, the dart reconfigures to activate no-go shoulder 164.

In this embodiment, in the inactive state, no-go shoulder 164 protrudes on outer housing but is collapsible due to the resiliency of outer housing. However, in the active form, a back support 168 is moved against outer housing 148 adjacent no-go shoulder 164 such that outer housing 148, and thereby no-go shoulder 164, are no longer able to collapse. In this illustrated embodiment, inner body 146 is shiftable within housing 148 and carries back support 168. Inner body 146 can be shifted by a hydraulic force, such as via a piston face 172 open to a hydraulic chamber 174. For example, a solenoid valve 170 may be provided that is operatively coupled to the control module and the circuit board via a line 156*d*. When the programmable controller senses that the next seat to be reached is the target seat, the control module is configured to actuate the valve 170 to open and flood chamber 174 to drive the inner body to move back support 168 behind the no-go shoulder to activate it.

While it is noted that annular protrusion 163 and no-go shoulder 164 are effectively the same structure in this embodiment, these parts could be separated without modifying the function of the tool.

Dart 124 is prepared for use by programming or configuring the control module to target a particular seat in a tubing string. For example, the dart's size parameters in the inactive condition are selected to ensure that it can fit though seats but be acted upon by the seats. The dart's parameters when activated are selected to be stopped on a seat. Dart 124 may also be programmed or configured by connection through port 154 to target a particular sleeve based on the number of that sleeve counting from surface. According to an embodiment the control module for the dart is configured with a communication interface that is coupled (wireless or cable connection) to an input device (e.g. a controller, computer, tablet, smart phone or like) and includes a user interface that queries the user for information and processes inputs from the user for configuring the dart and/or functions associated with the dart or the control module. External coupling may also check the condition of the dart's components, check or modify parameters, charge the battery, etc. After the count information is entered, any external connections are removed from port 154 and plug 162 is installed in hole 155.

Dart 124 is then ready for conveyance into a tubing string. The dart may be loaded into a plug dropping head and launched into the well.

Dart 124 is conveyed through the tubing string by gravity and fluid pressure acting against annular seal 125. When the dart reaches a sleeve, such as sleeve 122*a* (FIG. 3A), the dart must squeeze through the inner diameter constriction at the sleeve's seat 126 (FIG. 3B). When the dart's outer housing contacts seat 126 (FIG. 3A), the dart's progress tends to slow or stop and the applied fluid pressure against seal 125 pushes the dart through the seat, which compresses, arrows C, the outer housing (FIG. 3B). Every time outer housing 148 is compressed, all switches 140 are depressed at about the same time and one or more output signals are generated that are operatively coupled to circuit board 152 through lines 156*a*. The programmable controller in the control module is configured to count the seats that are passed.

Applied fluid pressure urges the dart through the seat and once the dart passes the seat, outer housing 148 returns to its neutral state, arrows D, removed from switches 140 (FIG. 3C).

This process is repeated for any seats through which the dart passes on its way to the target seat. At each seat, switches 146 are depressed by housing 148 and the output signal(s) is sensed and processed (e.g. counted) by the control module.

When the count of the control module determines that the dart is due to arrive next at the target seat, the control module is configured according to an embodiment to activate the dart to engage in the target sleeve such that the target sleeve can be actuated. According to one aspect, when the control module senses that the last seat has been passed before the target seat, the control module activates the sleeve-actuating mechanism of the dart. For example, it will be appreciated that since the dart's actuating mechanism includes a no-go shoulder 163 that is selected to land on the seat of the target sleeve, and all sleeves in the tubing string have substantially the same seat diameter and the dart must pass at least one seat to reach the target seat, the no-go shoulder cannot be activated until the dart has passed the last seat before the target seat.

Figure 3D:
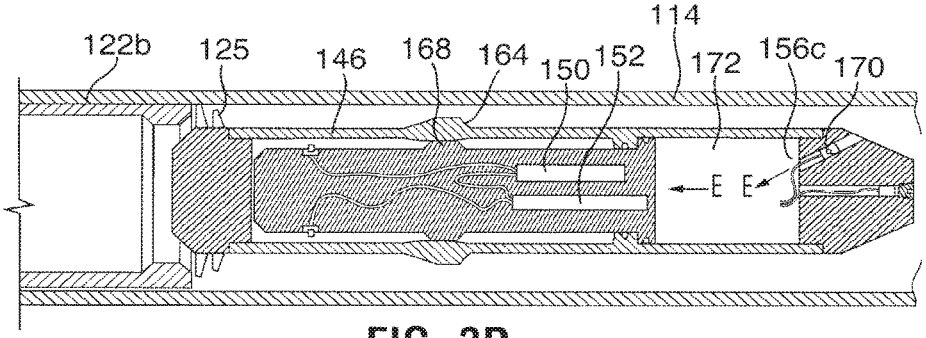
Figure 3E:
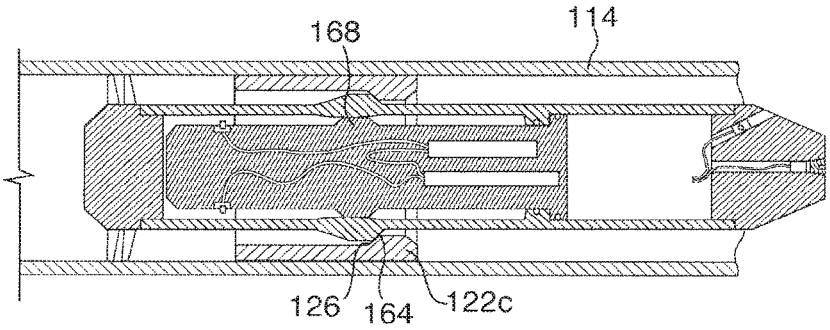

While the actuating mechanism could be activated upon arriving at the target seat, in this embodiment, the dart's actuating mechanism, in particular no-go shoulder 163, is activated once the dart passes the last seat before the target seat. Thus, in this embodiment, it is noted that sensing or identification of the target seat is actually by contact with the seats uphole of the target sleeve, rather than the target sleeve itself. Thus, as the dart passes the seat, in this case seat 122*b*, before its target seat 122*c*, the control module is configured to actuate through line 156*d*, valve 170 to open and thereby chamber 174 is flooded, arrows E, with fluid. This applies hydraulic force to face 172 on inner body 146 and causes inner body 146 to move back support 168 under the no-go shoulder to activate it (FIG. 3D). This prevents no-go shoulder 164 from collapsing and ensures that dart lands on and is stopped by the seat of its target sleeve 122*c* (FIG. 3E).

Since, after activation, no-go shoulder 164 cannot collapse, dart cannot pass through sleeve 122*c*. Thus, any pressure applied by fluid against seal 125 causes actuation at the sleeve, such as shifting and/or fluid diversion. In this embodiment, seal 125 creates a seal in the inner diameter 118 against which fracturing fluid can be diverted to a formation surrounding tubing string 114.

Thus, in this embodiment, dart 124 is programmed to have the third sleeve 122*c* in the tubing string as its target and after the dart passes the second sleeve 122*b*, the actuating mechanism is activated to stop the dart in the next sleeve 122*c*. The dart, therefore, feels its way along the tubing string by contacting (e.g. sensing and registering) the sleeves in the string and identifying the target sleeve based on the contacting information, for example, by counting and processing the count information.

Figure 3F:
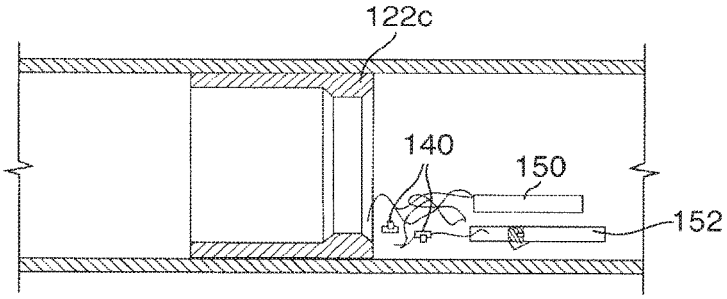
Figure 4:
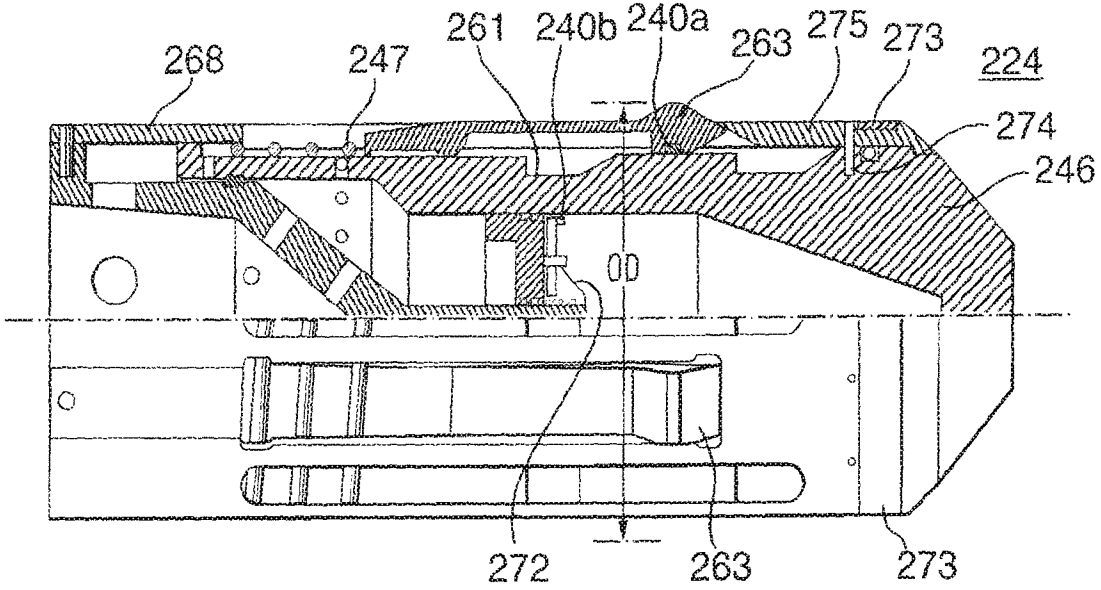
FIG. 4 is a schematic quarter sectional view through another actuation dart.

If the string is to be used for production, after the dart lands and seals in a seat to actuate its target tool, the dart may be configured to allow bypass of a fluids therepast. The dart may form a bypass therethrough in any of various ways. For example, a bypass port may be opened or all or a part of the dart may dissolve. In one embodiment, as shown in FIG. 3F, at least a portion of the dart is formed of material capable of breaking down, such as dissolving, at wellbore conditions. For example, the dart materials may break down in hydrocarbons, at temperatures over 90° or 100° F., after prolonged (>3 hours) contact with water, etc. In this embodiment, for example, after some residence time during hydrocarbon production, a major portion of the dart has dissolved leaving only components such as battery 150, the circuit board and switches 140. These components, being small in size can be produced to surface with the backflowing produced fluids.

To actuate another sleeve, such as sleeve 122*b*, a second dart may be employed. The second dart may be substantially identical to dart 124 except that it is programmed to target the second seat 122*b* and will squeeze through and count the seat of sleeve 122*a* before activating its no-go shoulder to land in and stop against the seat of sleeve 122*b*.

It is noted that the foregoing system does not require any electronics of power supplies in the string. As such, the string may be run in well ahead of the use of the darts, as there is no concern of battery charge, component damage, etc. Also, the string itself is requires little special preparation ahead of installation, as all sleeves are substantially the same and the number of sleeves although likely known ahead of run in, can be readily determined even once the string is installed downhole.

Another dart is shown in FIGS. 4 and 5A to 5F that locates its target sleeve 222*b* by counting the sleeves 222*a* uphole of the target sleeve. Dart 224 operates in a manner similar to dart 124, but includes some slightly different mechanisms to count the sleeves up hole of the target sleeve as it passes, arrows A, and to actuate the target sleeve. For example, the dart 224 includes a plurality of dogs 263 that protrude outwardly from the body of the dart and define an outer diameter OD thereacross that catches on sleeves in the tubing string while body 246 can pass. Dogs 263, when supported, may operate to stop the dart from passing a sleeve. However, dogs 263 can be placed in an unsupported configuration, wherein they are capable of collapsing inwardly to pass a sleeve. Dogs 263 are used, therefore, to both count the sleeves passed by the dart and as an actuation mechanism to act on the target sleeve 222*b*. Dogs 263 can be placed in the unsupported position for running into a tubing string 214 and can be configured to the supported position when the count indicates that the target sleeve is next to be reached.

Dogs 263, for example, are axially moveable along their installation site on the dart body 246 between a location (FIG. 4, FIGS. 5A, 5B, 5D and 5E) in which they are supported to maintain the outer diameter OD on the tool and a location (FIG. 5C), where they are positioned over an indentation 261 into which they can collapse to define a diameter generally equal to or less than the outer diameter of the body. The dogs are normally biased by a biasing member, such as spring 247, into the supported position but can slide to the unsupported position in response to a force applied against the spring. For example, while normally positioned in the supported location (FIG. 5A), when the dart contacts a sleeve 222*a*, such as in FIG. 5B, dogs 263 will butt against the sleeve and be pushed against the bias in spring 247 to a position over indentations 261, where they can collapse into the indentation (FIG. 5C) and allow the dart to pass the sleeve. When the dart passes the sleeve (FIG. 5D), the force against spring 247 is released and dogs 263 are driven to return to the supported position.

Dart 224 can include a counter including, for example, a proximity switch comprised of components including a magnet and a Hall Effect sensor 240*a*, 240*b* for each dog 263. The proximity switch senses when the dogs have collapsed. For example, switch 240*a*, 240*b*, which operates based on magnetically-sensed proximity, generates output signal for the control module that allow the dart to register and count when it passes a seat. For each of the dogs, one component, for example the magnet 240*a*, may be mounted on the dog and the other may be positioned in or beneath indentation 261 and a signal is generated each time the components come within a certain proximity to each other, such as when dog 263 collapses into the indentation. This signal is communicated or inputted by the control module which is configured to process, e.g. count, the signals.

When the count indicates that the next sleeve to be contacted is the target sleeve (FIG. 5E), the dart can be driven to reconfigure such that dogs 263 are no longer axially moveable and, therefore, can no longer collapse. For example, in this embodiment, when the control module determines that the number of sleeves passed equals one less than the number of the target sleeve, the controller permits a lock tube 268 to move to block any further axial movement of dogs 263, locking them in the supported position. In this embodiment, the control module is configured to overcome a setting member 272 to permit the lock tube 268 to move and hydrostatic pressure can drive the movement of tube 268. In this embodiment, the control module is configured to cause the destruction of setting member 272, which is in the form of a high strength filament, for example, a Kevlar™ string, holding the parts in place. In this embodiment, the high strength filament may be destroyed by burning, for example, by powering a coil about the filament when it is desired to destroy the filament. When dogs 263 are locked in the supported position, they cannot collapse and dart 224 lands on and is stopped by the next sleeve, which is target sleeve 222*b*.

In this embodiment, dart 224 drives sleeve 222*b* to move to open frac ports and the well accessed through the frac ports can be stimulated. Seal 273 seals against the inner diameter of sleeve 222*b* and prevents fluid from passing through the inner diameter past the sleeve and dart.

Figure 5A:
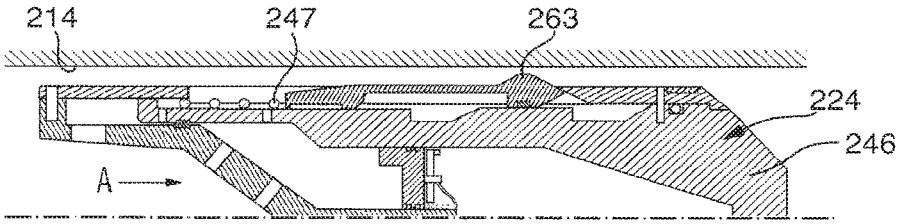
FIGS. 5A to 5G are schematic sectional views through a portion of a wellbore tubing string, the sequence of views showing a method of actuating a sleeve using the dart of FIG. 4.
Figure 5B:
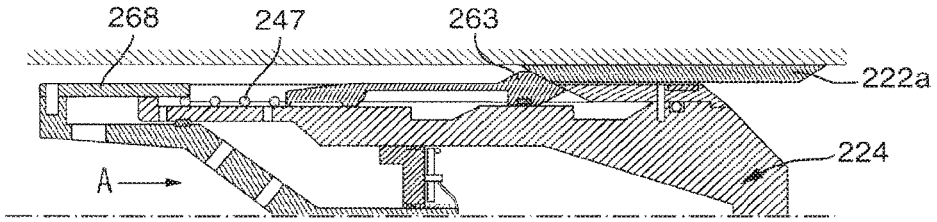
Figure 5C:
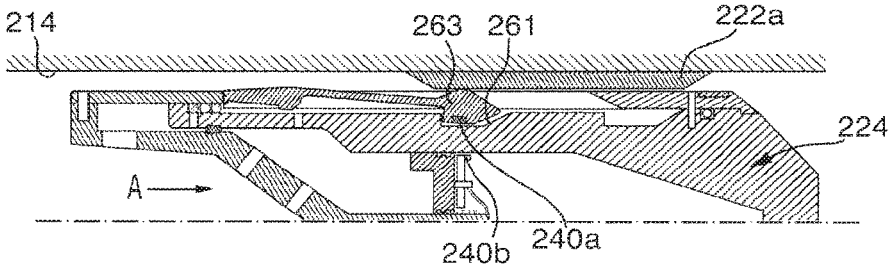
Figure 5D:
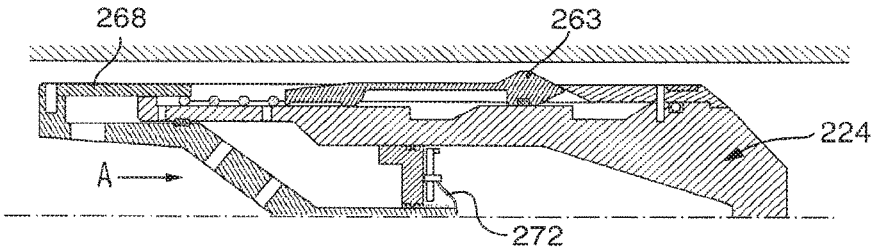
Figure 5E:
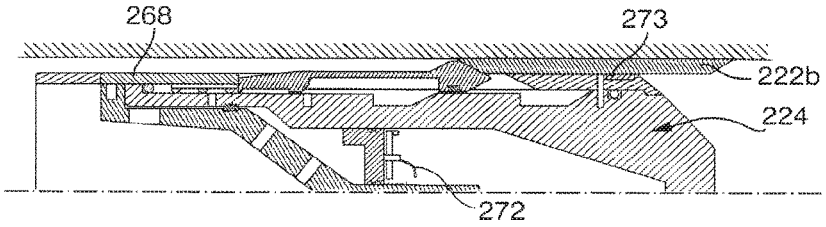
Figure 5F:
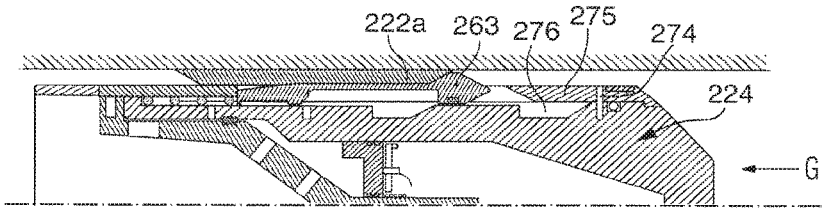
Figure 5G:
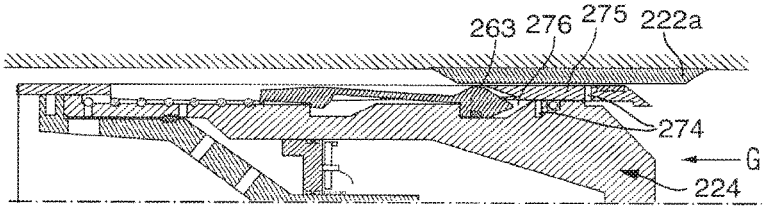

After the well begins to flow back, dart 224 will start to flow back, arrows G, with the produced fluids. When this happens, exposed dogs 263 hit the downhole end of the next sleeve 222*a* uphole (FIG. 5F). When fluid pressure builds up below dart 224, enough pressure is applied to shear pins 274 that hold the dogs in their active position. When pins 274 shear, a stop 275 is moved and dogs 263 can drop into an inactivation groove 276 and, therefore, reduce the diameter of dart 224 such that it can pass through the sleeve (FIG. 5G). The dart, with its clean outer diameter can then flow up and out of the well.

While the foregoing embodiments employ sleeves that are all substantially similar, it is to be understood that in some embodiments such as that described in FIG. 6, the target sleeve may be unique in some way compared to other sleeves of the string. In such an embodiment, a target sleeve may be specifically configured, differently than the other sleeves, to be responsive to or identifiable by contact with its dart. In one embodiment, the target sleeve has an identifier that can be recognized by the control module. According to an exemplary implementation, the identifier may include one or more electrical contacts that can be recognized by the control module.

Another actuation dart system is shown in FIGS. 6A to 6H. As with the dart systems described hereinabove, the system employs darts 324*a*, 324*b* for passing along, arrows A, a tubing string 314 and actuating a tool therein. In this embodiment, tubing string 314 in which darts 324*a*, 324*b* are to be used includes a plurality of sleeves, one of which is shown as sleeve 322 having a seat 326 thereon. While the sleeves may each be substantially similar in form, for example each have a substantially similar seat diameter, each sleeve has a unique identifier or signature. For example, each sleeve has a unique electrical identifier, which in this embodiment is an arrangement of electrical contacts 380 either in the sleeve or, as shown, in the tubular housing about the sleeve. While electrical contacts 380 are shown in the tubing string wall downhole of the sleeve's seat, it is to be understood that other positions are possible.

Each dart 324*a*, 324*b* is configured to have a selected one of the sleeves in the tubing string as a target. The darts each have control module configured to recognize a target sleeve, for example including a sensor for contacting the sleeve and determining if the unique electrical identifier is a match for the dart. The dart can be configured to pass through any sleeve that does not match the electrical identification it has a target.

For example, each dart includes an arrangement of electrical contacts that matches with one of the sleeves. As shown, dart 324*a* has an arrangement of contacts 382*a* and dart 324*b* has an arrangement of contacts 382*b*. The arrangements of contacts can be selected to be readily identifiable when the contacts of the dart contact the contacts of the sleeve. For example, the contacts on each sleeve and each dart can be unique according to their spacing. In this embodiment, sleeve 322 has a pair of contacts 380 that are spaced apart along the long axis x of the string by a distance d and darts 324*a*, 324*b* can be conveyed through the tubing string to contact the sleeve, the darts also having pairs of contacts with selected spacing. For example, dart 324*a* has a pair of contacts 382*a* that are spaced apart along the long axis of the dart by a distance d', while dart 324*b* has a pair of contacts 382*b* that are spaced apart along the long axis by a distance d, which is a smaller distance than distance d' but is the same as that distance d between the contacts on sleeve 322. The contacts on the darts may all be the same, but simply have different spacing.

By use of two contacts, many possible unique arrangements are possible. For example, with the spacing between adjacent contacts as the only variable, 18 possible spacings are available even if the distances are only varied by ¼ inch increments over a six inch total length. Even more unique arrangements are possible if the locations of the contacts along the tubing string are varied. For example, each dart may have a protrusion 364, for example, that catches on each sleeve's seat 326 when the dart arrives at the sleeve. Because protrusion 364 catches on seat 326, the darts progress is stalled at least momentarily and such residence time of the dart in the seat can be employed to arrive at unique contact arrangements by selecting the distance of the contacts 380 from seat 326 and likewise arranging contacts 382 on the dart to be correspondingly spaced from protrusion 364.

Based on the foregoing, it will be appreciated that dart 324*a* will not recognize the sleeve 322 as its target, since the spacing of the dart's contacts 382*a* is not the same as the spacing between the sleeve's contacts 380. However, dart 324*b* will recognize sleeve 322 as its target, since contacts 382*b* match, and both make simultaneous contact with, those on the sleeve.

As a dart moves through tubing string 314, it contacts the sleeves in the string and if the contacts on the sleeve and the dart line up, the dart identifies its target sleeve. Dart operations may be facilitated if the contacts 380, 382 are aligned substantially when the dart is landed against the seat. Thus, in one embodiment, the spacing between contacts 380 and seat 326 is selected to be substantially equal to the spacing between contacts 382 and protrusion 364.

Each dart can include a battery 350 providing power via lines 356*a* to the contacts 382, but the circuit cannot be completed until each contact 382*b* on the dart simultaneously contacts a contact 380 on the sleeve and the electrical circuit or connection is completed through contacts 380 and a line 356*b* between them. To facilitate contact between the contacts on the dart and those on the sleeve, either or both contacts 380 or contacts 382 may be biased to protrude outwardly. This ensures that the dart contacts can come into contact with the sleeve contacts, although the dart may not accommodate the full diameter of the tubing string inner diameter and may be moving quickly. In the illustrated embodiment, contacts 382 on the darts are spring loaded to be biased outwardly but can be pushed in to pass discontinuities in the string.

While various operations can occur as a result of the identification by a dart of its target sleeve, in this embodiment, the identification causes the dart to be retained in the sleeve and the sleeve to be opened to expose a fluid port 317 through tubing string 314 wall. As noted, the dart's protrusion 364, for example, can catch on each sleeve's seat as it passes them. While each dart is capable of passing through all non-targeted seats, the dart and/or sleeve are configured such that the dart is stopped against the seat of its target sleeve, when contacts 380, 382*b* line up indicating that the dart has arrived at the target sleeve. The matching of contacts 380, 382*b* drives a mechanism that converts seat 326 of the target sleeve 322 into an activated form to retain the dart in the sleeve and, thereby, opens port 317 and permits diversion of fluid through the port. In the illustrated mechanism, for example, seat 326 is run in in an inactive condition. Seat 326 may, for example, be formed of a collet-type structure, including a plurality of flexible fingers that can expand radially outwardly (arrows I, FIG. 6C) when force is applied thereto, except if they are supported on their back side (FIG. 6G). The arrival of the dart at its target sleeve completes a circuit (e.g. an electrical connection) including battery 350, contacts 380, 382, and lines 356*a*, 356*b* that powers a solenoid 386 to open. Solenoid 386 controls the open/closed condition of an equalization conduit 388 controlling the movement of sleeve 322. For example, when solenoid 386 is closed (FIG. 6A), the sleeve is pressure locked in a closed position. However, when solenoid 386 is open (FIG. 6A), hydrostatic pressure, arrows H, can be communicated through conduit 388 to a pressure chamber 390 behind sleeve 322 such that it is free to move and, in fact, may be driven to move. Movement of sleeve 322, both (i) activates seat 326 by moving it to a position supported at its back side and (ii) opens port 317.

Solenoid valve 386 can only open when powered to do so Since there is no power source installed in the tubing string, solenoid 386 is openable only when the circuit is completed to connect the solenoid to the power source in the dart. In one embodiment, such as noted above, solenoid 386 may only open if the dart's residence time in contact with contacts 380 is sufficiently long. For example, solenoid 386 can only open if the contacts line up during the pause when the dart is landed in seat 326 rather than when the dart is moving quickly past the contacts, before or after it has landed in the seat.

Before running in, tubing string 314 is constructed using a plurality of sleeve subs including sleeves 322 installed in the tubing string inner diameter and unique contacts 380 for each sleeve. As required, the sleeve subs may also include selected actuation mechanisms such as solenoid 386, etc. for the sleeve and for operation with the dart system. The unique contact arrangement is recorded along with the location for each sleeve sub in the tubing string. The activated seat diameter may be substantially similar for all seats.

The tubing string is then installed in the well. In this embodiment, the string is run in with sleeves 322 overlying and, therefore, closing their ports 317 and solenoid 386 closing a fluid conduit 388, which locks the sleeve in a port-closed position.

A plurality of darts 324*a*, 324*b* are prepared by installing contacts 382*a*, 382*b* in a particular arrangement in each dart, which arrangements each correspond to one sleeve in the tubing string. Each dart is also provided with a power source 350 and wires 356*a* to connect each contact 382 to the power source. Of course, each dart is also selected to have a diameter that will be stopped by an activated sleeve seat.

Darts 324*a*, 324*b* are then ready for conveyance into a tubing string. The darts may be loaded into a plug dropping head and launched into the well.

Figure 6A:
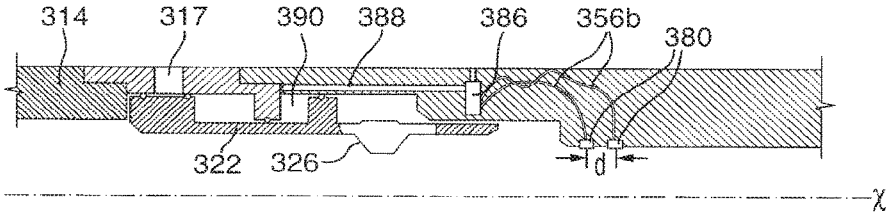
FIG. 6A to 6H are schematic sectional views through a portion of a wellbore tubing string, the sequence of views showing a method of actuating a sleeve using a dart.
Figure 6B:
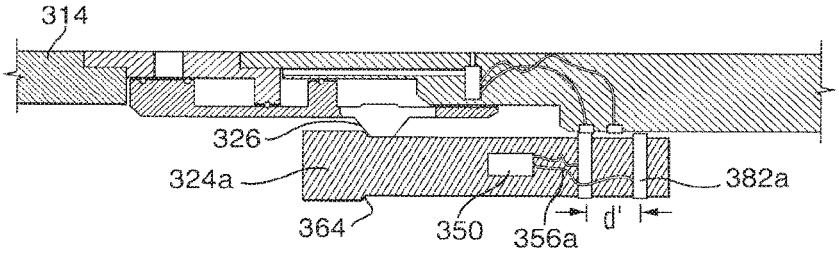
Figure 6C:
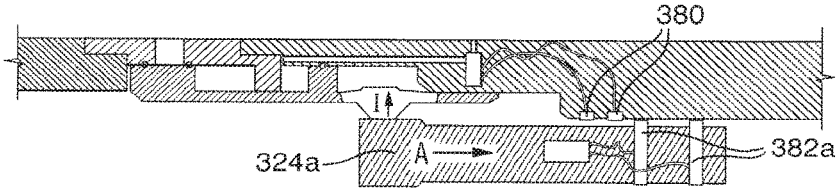

Dart 324*a* is shown in FIG. 6B being conveyed, arrow A, through the tubing string. When the dart reaches sleeve 322, contacts 382*a* pass over contacts 380. However, the contacts don't line up (i.e. the two contacts on dart 324*a* do not line up and do not make simultaneous contact with the contacts 380 on sleeve because their spacings are different). Thus, the control module fails to identify this sleeve as the target sleeve for dart 324*a*. While the dart's progress, arrows A, may tend to slow or stop as the dart catches on seat 326, the dart is not stopped by the sleeve and dart 324*a* pushes through the seat, which expands, arrows I (FIG. 6C). If fluid pressure is used to push the dart through the string, a pressure pulse may be sensed on surface when dart 324*a* passes through the seat. Thus, pressure may be monitored to track the progress of the dart through the string, noting pressure spikes in the pumping fluid indicating when a dart has passed a sleeve.

Figure 6D:
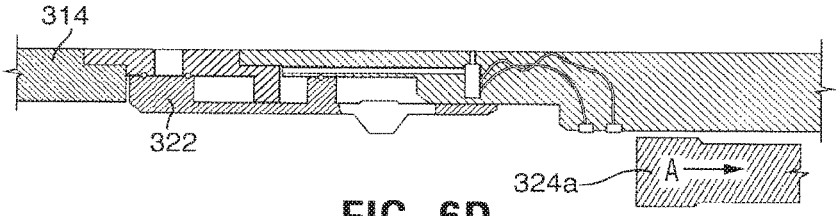
Figure 6E:
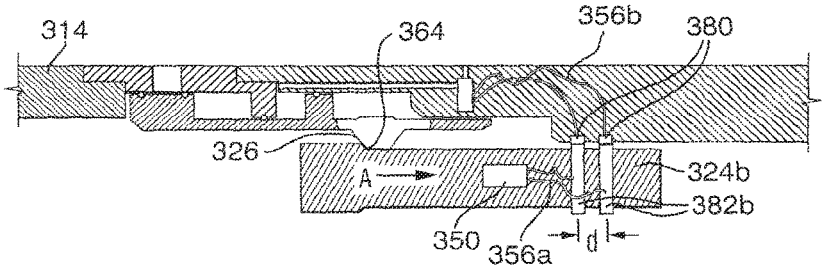
Figure 6F:
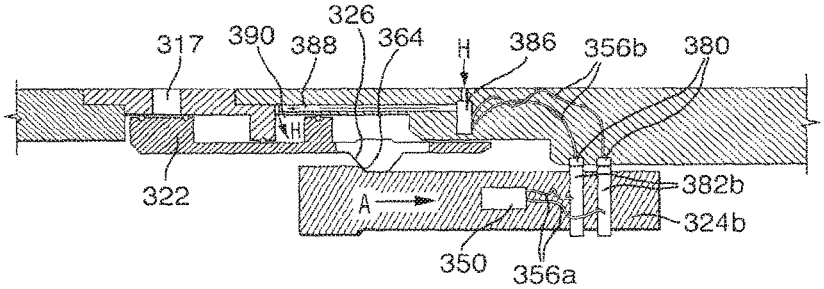
Figure 6G:
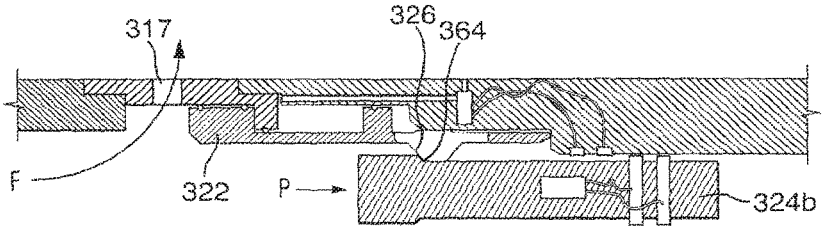

Once the dart passes the seat, seat 326 returns to its neutral state (FIG. 6D). Dart 324*b* continues on through the string to locate the sleeve having a matching arrangement of contacts, which is its target sleeve.

Eventually, another dart 324*b* is launched and conveyed that has contacts 382*b* that line up with the contacts 380 on sleeve 322. When the contacts 380, 382*b* simultaneously line up, a circuit is completed such that power from the dart's battery 350 may be communicated to solenoid 386. When solenoid 386 is powered, it opens chamber 390 to hydrostatic fluid, arrows H. The fluid pressure in chamber 390 and/or pressure applied through dart 324*b* pushes sleeve 322 down to open port 317 and to activate seat 326. In the active state, seat 326 cannot expand and thus dart 324*b* cannot pass through sleeve 322. Seat 326 becomes activated when sleeve 322 shifts down since the seat moves to a position where wall 392 supports the backside of the collet such that the fingers cannot expand outwardly.

Seat 326, being unable to expand, creates a substantial seal with the dart body such that fluid pumped into the string may be diverted, arrows F, through port 317 (FIG. 6G).

Figure 6H:
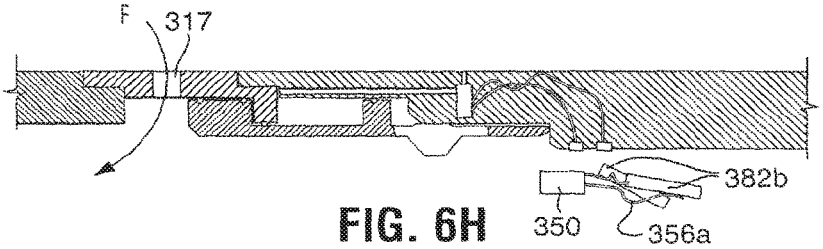

If the string is to be used for production, after the dart, lands and seals in a seat to actuate its target tool, the dart may be configured to allow bypass of a fluids therepast. The dart may form a bypass therethrough in any of various ways. For example, a bypass port may be opened or all or a part of the dart may dissolve. In one embodiment, as shown in FIG. 6H, at least a portion of the dart is formed of material capable of breaking down, such as dissolving, at wellbore conditions. For example, the dart materials may break down in hydrocarbons, at temperatures over 90° or 300° F., after prolonged (>3 hours) contact with water, etc. In this embodiment, for example, after some time when the hydrocarbons start to be produced, a major portion of the dart has dissolved leaving only components such as battery 350, contacts 382 and wires 356*a*, which can be produced to surface with the backflowing produced fluids.

As a contingency, a dart can be configured to match with all the sleeves as by providing a pair of contacts that meet all of the possible locations of the contacts along the string. As such, in the event that all tools need to be quickly actuated, that dart with the universal contacts could be run through the string and either without a protrusion or with a collapsible protrusion if residence time is required for actuation, such that each tool's sleeve is actuated.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. An actuation dart conveyable through a tubing string for actuating a first tool in the tubing string, said tubing string also having a second tool located uphole from the first tool, the actuation dart comprising:

a body conveyable through the tubing string, the body including a radial protrusion;

a magnet and a magnetic sensor, wherein a change in proximity between the magnet and the magnetic sensor occurs in response to movement of the radial protrusion provided on the body when the dart makes contact with the second tool, and wherein the magnetic sensor is configured to generate an output signal in response to said change in proximity;

a control module, including a circuit having a central processor unit, configured to receive the output signal, process the output signal and send an activation signal based on said processing; and an actuation mechanism for activating the actuation dart after receiving the activation signal.

2. The actuation dart of claim 1 wherein the control module processes the output signal in counting a number of downhole tools past which the actuation dart has been conveyed, by adding the output signal to a count of other output signals the control module has previously received.

3. The actuation dart of claim 2 wherein the central processor unit includes an interface for programming and configuring the control module.

4. The actuation dart of claim 2 wherein the central processor unit sets a target number and compares the target number against the number of downhole tools past which the actuation dart has been conveyed.

5. The actuation dart of claim 4 wherein the actuation mechanism is activated when the number of downhole tools past which the actuation dart has been conveyed, is not less than the target number.

6. The actuation dart of claim 1 wherein the actuation mechanism is inactive until the dart has been conveyed past the second tool.

7. The actuation dart of claim 1, wherein the actuation mechanism includes a power supply for supplying power to the actuation mechanism.

8. The actuation dart of claim 1, wherein the body comprises a protrusion for engaging the first tool.

9. The actuation dart of claim 1, wherein the body is in a collapsible state and conveyable through the tubing string past the second tool, and is in a non-collapsible state and not conveyable through the tubing string first tool.

10. In a tubing string that contains a plurality of tools, a method for actuating a first tool from amongst the plurality of tools, performed by an actuation dart comprising a body including a radial protrusion, a control module, an activation mechanism, a magnet and a magnetic sensor, the method comprising:

moving the actuation dart through the tubing string past a subset of the plurality of tools that are uphole from the first tool;

sensing a change of proximity of the magnet and the magnetic sensor caused by movement of the radial protrusion when the actuation dart makes contact with a second tool from amongst the plurality of tools, wherein no other tools are located between the first tool and the second tool;

processing said contact in response to the sensing, activating the actuation mechanism in response to said processing, and actuating the first tool in response to said activating.

11. The method of claim 10 wherein activating the actuation mechanism comprises causing the actuation dart to assume a non-collapsible state.

12. The method of claim 10 wherein said sensing comprises sensing an identifier associated with the second tool.

13. The method of claim 10 wherein actuating the first tool comprises stopping the actuating dart at the first tool.

14. The method of claim 10 wherein actuating the first tool further comprises creating a seal in the tubing string adjacent the first tool to block fluid flow past the first tool.

15. The method of claim 10 wherein actuating the first tool further comprises opening a port of the first tool and creating a seal in the tubing string downhole of the port, to divert fluids to the port.

16. The method of claim 10 wherein the first tool is one of a packer and a fluid treatment port.

17. An actuation dart for actuating a target tool from a plurality of tools provided in a tubing string, the actuation dart comprising:

a body, including a radial protrusion capable of movement relative to the rest of the body upon each occurrence of a passage of the dart past one of the plurality of tools;

a magnet and a magnetic sensor positioned in the body, wherein a change in proximity of the magnet and the magnetic sensor occurs in response to each movement of the radial protrusion, and wherein the magnetic sensor generates an output signal in response to each said change in proximity;

a control module including a circuit having a central processor unit, said control module adapted to receive each output signal, process each output signal to register an occurrence of a passage of the dart past one of the plurality of tools, and generate an identification of the target tool upon counting a pre-defined number of received output signals, wherein the control module is configured to generate an actuation signal to trigger a change of state in the body for engaging and actuating the target tool, upon said identification of the target tool.

18. The actuation dart of claim 17, wherein the body includes a hydraulic chamber, adapted to be flooded in response to identification of the target tool to cause an annular protrusion on the body to engage and actuate the target tool.

19. The actuation dart of claim 17, wherein the magnetic sensor is a Hall Effect sensor.

* * * * *